US005816824A

United States Patent [19]

White et al.

[11] Patent Number: 5,816,824

[45] Date of Patent: Oct. 6, 1998

[54] HOLDER FOR A VEHICLE ELECTRICAL CONNECTION COMPONENT

[76] Inventors: James E. White; Kenneth C. Nolan, both of 2801 24th St., Lubbock, Tex. 79410

[21] Appl. No.: 515,693

[22] Filed: Aug. 16, 1995

[51] Int. Cl.[6] ..... H01R 33/00

[52] U.S. Cl. ..... 439/35; 439/456; 439/142; 439/731

[58] Field of Search ..... 439/35, 142, 687, 439/696, 731, 456

[56] References Cited

U.S. PATENT DOCUMENTS

| | | |
|---|---|---|
| 2,158,385 | 5/1939 | Schwien . |
| 3,059,073 | 10/1962 | French . |
| 3,585,907 | 6/1971 | Rochla . |
| 3,981,555 | 9/1976 | Deurloo . |
| 4,057,310 | 11/1977 | Young . |
| 4,348,035 | 9/1982 | Wasservogel . |
| 4,544,222 | 10/1985 | Andersson . |
| 4,734,055 | 3/1988 | Misu . |
| 5,067,913 | 11/1991 | Sagawa ..... 439/595 |
| 5,380,209 | 1/1995 | Converse, Jr. et al. ..... 439/35 |

*Primary Examiner*—Neil Abrams
*Assistant Examiner*—Eugene G. Byrd
*Attorney, Agent, or Firm*—Royston, Rayzor, Vickery, Novak & Druce, L.L.P.

[57] ABSTRACT

A holder for an electrical connection component to be mounted upon a towing vehicle. The holder includes a retainer for fixedly receiving the electrical connection component and exposing electrical contacts thereof through a closable aperture of the holder. During use, a closure or door is held open by a plug from the trailer's electrical lighting system, but is allowed to securely close when the plug is not installed. A baffle type friction path is provided within the holder for securing lead wires of the electrical connection component so as to prevent undue tension at the more fragile connection between those lead wires and the electrical connection component. When completely assembled, the holder provides a moisture and particulate barrier between the electrical connection component contained therein and the outside environment.

20 Claims, 3 Drawing Sheets

HOLDER FOR A VEHICLE ELECTRICAL CONNECTION COMPONENT

FIELD OF THE INVENTION

This invention relates to electrical connections, and more particularly to electrical connections between towing and trailer vehicles, including holders for the components that achieve the electrical connections.

BACKGROUND OF THE INVENTION

For many years, motor vehicles have been used to tow non-powered trailers. The combination of a towing vehicle and a trailer is found in both commercial and private transportation. In the instance of commercial tractors and trailers, connections between the two must be made for utilities such as electrical power, hydraulic fluid pressure, and air pressure. Because of frequent connection and disconnection in the commercial environment, the mating members have been designed to provide not only quick and easy engagement and disengagement, but also to incorporate protective coverings and fixtures for the connecting members, or plugs and receivers.

With respect to private trailers, which typically include utility, recreational, and boating trailers, the electrical connections are not as sophisticatedly designed. Reasons for the lack of sophistication are infrequent use under normal circumstances and lower required capacities. In private use, the most common connection is for conveying electrical power from the towing vehicle's electrical system to the trailer's lighting system since all trailers for use upon United States public roadways require some lighting configuration. For that reason, almost all trailers have wired electrical connections that are connectable with the towing vehicle's electrical system.

In many situations, the electrical connections and wire leads thereto are strung in an unsecured fashion at the tongue of the trailer and the tail end of the towing vehicle. In some cases, the wiring on the towing vehicle maybe stored within the trunk or similar enclosure thereby protecting the wiring and connection when not in use. During use, however, the connection must be dangled from where it is normally stored in an unprotected fashion and without securement to the towing vehicle except at its connection to the wiring system. Likewise, during use and storage, the wiring upon the trailer will be similarly dangled in an unprotected and unsecured manner. In the case of a private trailer, the unprotected and unsecured configuration is less detrimental because use of the trailer is relatively infrequent and for shorter periods of time when compared to the motorized towing vehicle. When not in use, the trailer is normally protected in a garage or similar enclosure.

With respect to the towing vehicle, a need has been recognized for a temporary receptacle outside the vehicle for the electrical connection. Such a connection should include a protective enclosure for the conventional electrical connection and a means for securing the connective wire between that connection and the electrical system of the towing vehicle so that applied tensions to the wiring are not transmitted to the more fragile connections at the connector itself. Of particular interest are holders for four prong flat connections which have not been previously provided.

SUMMARY OF THE INVENTION

The present invention provides a holder or housing for a receiver of an electrical connection upon the towing vehicle of a trailer and towing vehicle combination. More particularly, the holder of this invention is suitable for housing four prong connectors which are the most commonly used connectors in the electrical systems of privately owned trailer systems. The holder may be removably or permanently mounted upon the towing vehicle at a convenient location, usually near the hitching assembly. Alternatively, the location of the holder may be selected based upon the location of the leads from the trailer to be connected to the receiver contained therein. While it is contemplated that the holder may be temporary in nature and removable from the exterior of the vehicle, it is likewise anticipated that the holder will become a permanent fixture upon the vehicle and the receiver mounted therein for service until a need arises to remove the receiver from the holder. From this, the obvious advantage of having the receiver permanently and readily available for use is seen. Furthermore, because of the ease with which the receiver maybe installed or removed from the holder makes repair or modification to the receiver itself simple and easy. Similarly, the versatility of the holder as an original equipment or retrofit item is seen.

As designed, the holder provides a friction means within its interior for pinning wire leads of the receiver. In one embodiment, a baffle type structure is utilized which effectively pins the lead wires proximate to their connection to the receiver so that any tension applied to the wire outside of the holder is resisted along the wire's length at the baffle, and not at the more fragile connection points at the receiver. To better provide a complete enclosure within the holder, a wiring orifice is included having a suitable size for accommodating the diameter of the wire. Clearance thereabout is minimum to prevent admission of foreign matter into the interior of the holder. Furthermore, a sealant material is provided between the orifice and wire(s) to assure that a moisture resistant seal is achieved there between. The housing of the holder is designed to be at least moisture resistant so that the electrical connection components contained within the interior space of the holder are kept dry and protected from the outdoor environment.

A closure in the form of a closable door is provided over a closeable opening that typically faces away from the towing vehicle and toward the trailer. The electrical contact, or receiver portion of the electrical connection is positioned within the holder so that the contacts of the receiver are positioned at the aperture and facing outwardly, but protectively contained within the confines of the holder when the door is closed.

In summary, the present invention provides a semi-permanent protective environment for the electrical connection component of an electrical system connection on a towing vehicle.

In one embodiment of the present invention, a holder for a vehicle electrical connection component is provided. The holder includes a housing having a base and a top. The base generally constitutes a bottom half of the housing while the top constitutes a top half. The base has a generally upward extending base flange positioned about a perimeter of the base. The base flange terminates in a base lip at an upper surface thereof. The top similarly has a generally downward extending top flange positioned about a perimeter of the top. The top flange terminates in a top lip at a lower surface thereof. The top lip is adapted to abuttingly engage the base lip. The holder further includes a retainer for an electrical connection component fixed within the housing and a closable opening through the housing for permitting access to an interior space of the housing. Also within the housing is a frictional wire path for resisting relative movement between wires lodged therein and the housing.

It is contemplated that the abutting engagement between the base and the top mates the base to the top thereby creating a moisture resistant seal therebetween. The seal also provides a particulate barrier.

The frictional wire path has a plurality of baffle vanes, where each vane has a distal end. The distal ends of adjacent baffle vanes opposingly project toward and beyond one another so that a wire installed within the path frictionally engages the distal end of each baffle vane.

The housing further includes a wiring orifice located generally opposite the closeable opening. Furthermore, the wiring orifice optionally incorporates a sealant at an interior surface thereof for establishing sealing engagement with a wire extending through the orifice.

In one embodiment, the retainer for an electrical connection component is integrally formed with the base. The retainer further includes an upwardly extending flexible finger. The finger has an inward projection proximate to an upper end of the finger for releasably engaging an electrical connection component within the retainer. In an alternative embodiment of the retainer, the finger is elongated into an upwardly extending rail having an inward projection proximate to an upper surface of the rail for releasably engaging an electrical connection component within the retainer. The rail has a length and is capable of supporting an electrical connection component upon the upper surface of the rail. The top also includes a downwardly projecting stabilizer for engaging the electrical connection component supported upon the rails.

The present invention also includes a closure for the closable opening. The closure has a closure lip that securely engages an opening lip of the closable opening thereby establishing a moisture resistant seal therebetween when the closure is in a closed position. The closure is pivotally connected to the housing by a hinge formed at an exterior surface of the housing. A frictional indentation is located upon an exterior surface of the closure substantially opposite to the hinge. The indentation facilitates an operator's grasping engagement of the closure.

In an alternative embodiment of the closeable cover, a tab or tongue is provided that extends from the distal end of the door opposite the hinge. The tab extends over a portion of the exterior surface of the base adjacent to the door in the closed position. In this alternative embodiment, a frictional indentation is not required, however, it may be optionally provided. Normally, the thickness of the tab that extends outwardly away from the base provides a sufficient finger or thumb hold for an operator to pull against and open the door. Additionally, in this embodiment a latching means may be provided between the tab and base to assure that the door remains in the closed position until intentionally opened.

The exterior surface of the closure fits flushly to the exterior surface of the housing thereby presenting a uniform exterior surface of the holder at an intersection between the closure and the housing.

The holder also has a connection assembly for coupling the holder to a carrying vehicle. The connection assembly includes a tubular aperture extending through the housing from an upper housing surface to a lower housing surface. The tubular aperture terminates in a recess at the exterior surface of the housing.

In one embodiment, the i-older is constructed exclusively from plastic. Still further, in use the holder is mounted to a bumper of a carrying vehicle by self-tapping headed screws positioned within the tubular apertures and extending through the housing. A head of the screw is located within the recess at the exterior surface of the housing so that the screw does not extend beyond the housing's exterior surface.

DESCRIPTION OF THE PREFERRED EMBODIMENT(S)

Figure 1:
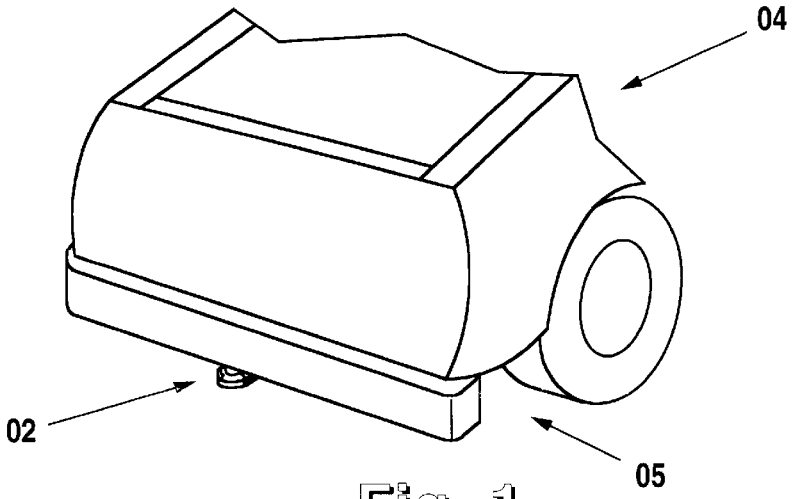
FIG. 1 is a perspective view of the electrical connection component holder mounted upon the bumper of a carrying vehicle.

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefor, specific structural and functional details disclosed herein are not to be interpreted as limiting, but merely as a basis for the claims and as a representative basis for teaching one skilled in the art to variously employ the present invention.

Certain terminology will be used in the following description for convenience and reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure being referred to. This terminology will include these words, specifically mentioned derivatives thereof, and words of similar import.

Referring to FIG. 1, a perspective view of a holder 02 on a carrying or towing vehicle 04 is shown. In this particular embodiment, the holder 02 is mounted below a bumper 05 of the vehicle 04. For purposes of the disclosure made herein, a back-side of the holder 02 will be considered to be that side facing toward the back-end of the carrying vehicle 04; likewise, the front-side of the holder 02 faces the front-end of the carrying vehicle 04. As explained above, the holder 02 provides a protective receptacle for an electrical connection component 06, also referred to as a receiver, of a lighting connection assembly between the towing vehicle 04 and a towed trailer. The holder 02 is substantially moisture tight, as well as impervious to dust and other fouling particulate. This is important for protecting the electrical contacts 09 of the electrical connection component 06. In a typical configuration, the electrical connection component 06 will be connected to the lighting system of the carrying vehicle 04 by electrical wiring 08. The trailer's lighting system is controlled and powered through the connection by the vehicle's lighting system. The two lighting systems are configured so that similar signals are produced in the carrying vehicle 04 and the trailer. As an example, when the brakes are applied in the towing vehicle 04, the brake lights of that vehicle 04 are illuminated, together with the brake lights on the trailer. It is desirable that the electrical connection component 06 on the towing vehicle 04 be secured relative thereto so that forces applied to the electrical connection component 06 be resisted by the body of the vehicle 04, and not the electrical wiring 08 connection between the receiver 06 and the vehicle's 04 electrical system.

The present invention provides a structure within which the electrical connection component 06 can be accommodated in a relatively protected and controlled environment. It also provides a means for securing the receiver 06 upon and relative to the vehicle 04. As may be more clearly appreciated in FIG. 2, the holder 02 comprises a housing 10 having an exterior surface 14 and an interior space 12 defined therein. An upper exterior surface 16 located on a top 40 of the housing 10 is designed for abutting engagement with the carrying vehicle 04 as illustrated in FIG. 1. A lower exterior surface 18 located on a base 20 of the housing 10 is oppositely located to the upper surface 16.

Figure 2:
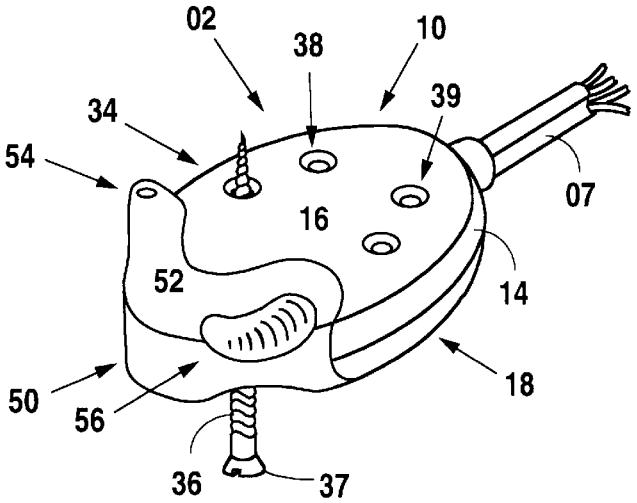
FIG. 2 is a perspective view of the electrical connection component holder in a closed orientation.
Figure 3:
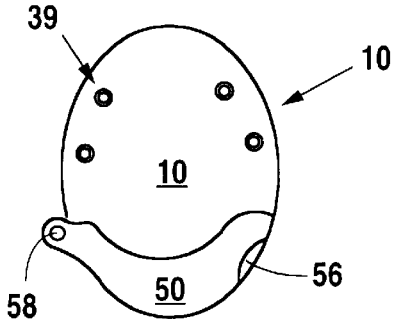
FIG. 3 is a plan view of the electrical connection component holder in a closed orientation.
Figure 10:
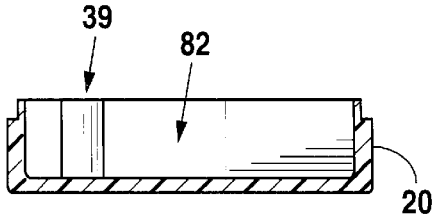
FIG. 10 is a sectional view taken along line 10—10 of FIG. 5 showing a baffle vane with a tubular aperture of the connection assembly partially formed therein.
Figure 11:
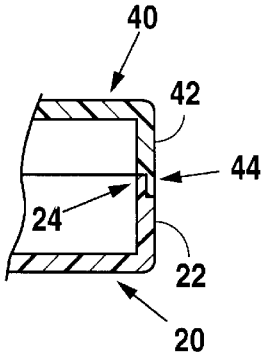
FIG. 11 is a broken away sectional view of an abutting engagement connection between the top and base of the holder.

As may be appreciated in FIG. 2, the top 40 and base 20 fit together in a clam-shell type fashion to form at least a portion of the enclosure of the housing 10. The base 20 has a base flange 22 located at least partially about a perimeter of the base 20. The flange 22 extends upwardly around the perimeter so that the flange 22 forms a wall thereabout. A base lip 24 is formed at an upper surface of the flange 22. As may be clearly seen in FIGS. 9 and 10, a top end of the flange 22 has an exterior recess cut out thereabout so that the lip 24 projects above the lower portion of the flange 22 and has a thickness of about one-half that of the remainder of the flange 22. Similarly, the top 40 has a top flange 42 that extends downwardly around a perimeter of the top 40 so that the flange 42 also forms a wall thereabout. Likewise, a top lip 44 is similarly formed at a lower surface of the flange 42, however, a recess is located upon the interior surface of the flange 42, instead of an exterior surface. As shown in FIG. 11, the top and base lips 44,24 are reversed one to the other and are designed to mate with each other. The top 40 and base 20 may interlock by such means as a snapping mechanism, or as shown in FIG. 11, the lips 24,44 fit sufficiently snugly to create a friction fit therebetween that resists disengagement. As will be explained with respect to installation of the holder 02 upon the carrying vehicle 04, it is not required that the fit between the top 40 and base 20 be tight enough to independently hold the housing 10 together during operation, but merely strong enough to maintain the clam-shell configuration during assembly and installation of the holder 02 to the vehicle 04. In any event, the lips 24,44 fit sufficiently close together to create a moisture resistant seal therebetween. The seal also resists the passage of solid contaminants, such as dust and other small particulate to which the holder 02 may be exposed when carried upon the underside of the bumper 05 of the carrying vehicle 04.

The top 40 and base 20 form only a portion of the enclosure of the holder 02 because a back side of the housing 10 terminates in a closeable opening 90. The enclosure of the holder 02 is completed by a closure 50 that takes the form of a door pivotally connected to the housing 10 at a hinge 54. A back edge of the housing 10 that establishes the opening 90 terminates in an opening lip 92 similar to the base and top lips 24,44. A closure lip 57 of the closure 50 mates with the opening lip 92 to form an impervious seal when the closure 50 is in the closed position. Much like the fit between the base 20 and top 40, the fit between the closure 50 and the opening 90 creates a seal, but may not alone be sufficiently secure to maintain the closure 50 in the closed position under use conditions. Therefor, a secondary snap or mechanical latch may be incorporated to secure the closure 50 in the closed position. Because of the sureness of the fit between the closure 50 and the housing 10 and the optional latching mechanism, a frictional indentation 56 is provided on the closure 50.

Figure 13:
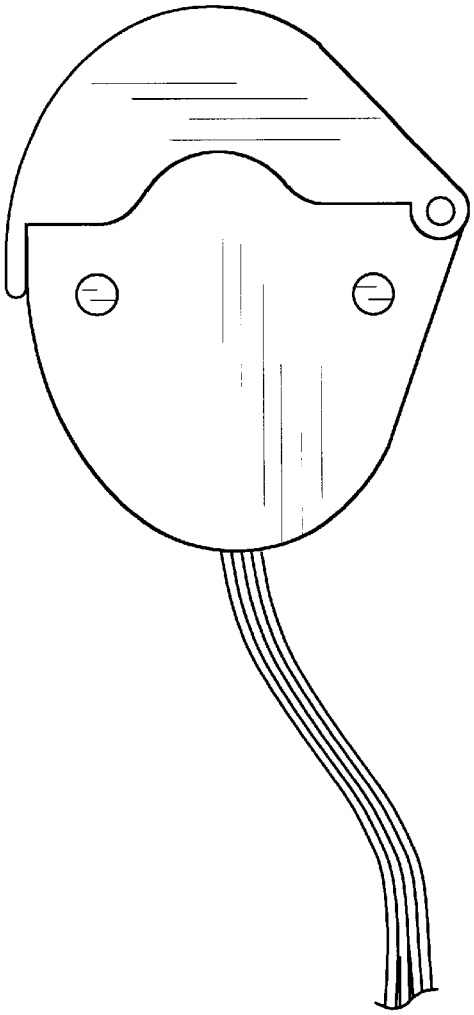
FIG. 13 is a top view of the alternative embodiment in which a tab is incorporated into the closeable cover or door.
Figure 14:
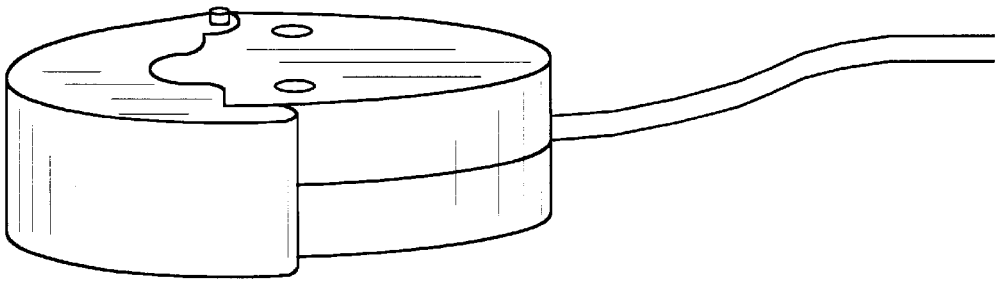
FIG. 14 is a perspective view of the alternative embodiment in which a tab is incorporated into the closeable cover or door.

In the alternative embodiment of FIGS. 13 and 14, a tab or tongue is provided upon the closeable cover, closure or door that extends from the distal end of the door opposite the hinge. The tab extends over a portion of the exterior surface of the base adjacent to the door in the closed position. In this alternative embodiment, a frictional indentation is not required, however, it may be optionally provided. Normally, the thickness of the tab that extends outwardly away from the base provides a sufficient finger or thumb hold for an operator to pull against and open the door. If a frictionally enhanced surface is provided in this alternative embodiment, it will most often be placed upon the exterior surface of the tab itself. Additionally, in this embodiment a latching means may be provided between the tab and base to assure that the door remains in the closed position until intentionally opened.

Figure 6:
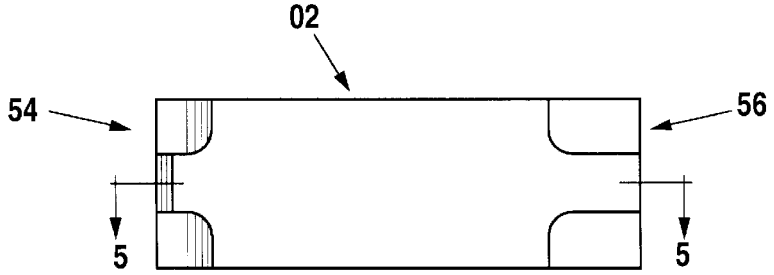
FIG. 6 is a back view of the holder.

The indentation 56 is located substantially opposite to the hinge 54 thereby maximizing the leverage effect across the width of closure 50. The indentation 56 is configured to accommodate an operator's grasp between pinched fingers. To prevent slippage of the fingers during the opening process, frictional ridges are provided upon a surface of the indentation 56. FIG. 6 provides an exaggerated back view of the holder 02 showing the hinge 54 assembly oppositely positioned to the frictional indentations 56.

The closure 50 has an exterior surface 52 that constitutes a portion of the exterior 14 of the housing 10. When in a closed position, the exterior surface 52 of the closure 50 matches the balance of the exterior surface 14 of the housing 10 so that a smooth and substantially contiguous exterior is presented.

Figure 4:
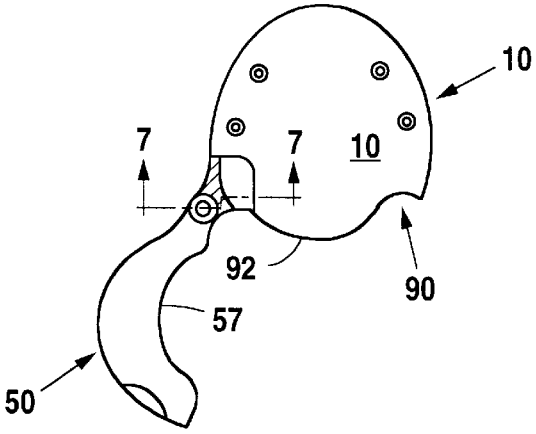
FIG. 4 is plan view of the electrical connection component holder with the door in an open position and a partial cut-away about the door's hinge.
Figure 7:
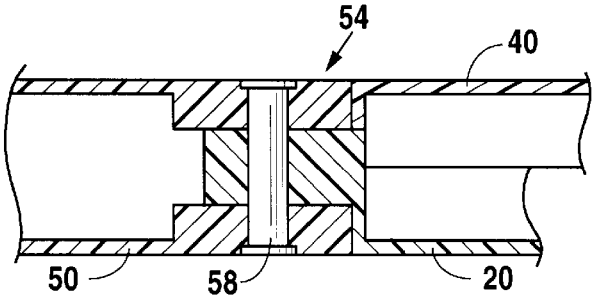
FIG. 7 is sectional view of the hinge assembly taken along line 7—7 as illustrated in FIG. 4.

The hinge 54 is detailed in FIGS. 4 and 7 where the mated top 40 and base 20 are secured to said closure 50 by pin 58 for relative rotation therewith. Referring to FIG. 7, a bore through the base 20 may be seen that corresponds to bores through the closure 50 when properly aligned to facilitate insertion of the pin 58. Recesses are provided at the exterior ends of the bores on the closure 50 so that expanded end portions of the pin 58 are contained within the closure 50 and present an exterior surface flush with that of the closure 50.

In addition to the closeable opening 90, a wiring orifice 30 is typically provided at the front side of the housing 10, opposite the closeable opening 90. The wiring orifice 30 permits electrical wiring 08 to extend through the holder 02 between the electrical connection component 06 and the carrying vehicle's 04 electrical system. The orifice 30 may be sized to fit snugly about the wiring 08, or a pliable sealant 32 may be provided at an interior edge of the orifice 30. It is contemplated that the sealing material may be a pliable synthetic such as plastic or rubber. In the preferred embodiment, the orifice 30 is created at the intersection of the base 20 and top 40 by providing matching recesses on each that form the orifice 30 when the two components are mated together to form the housing 10.

Figure 5:
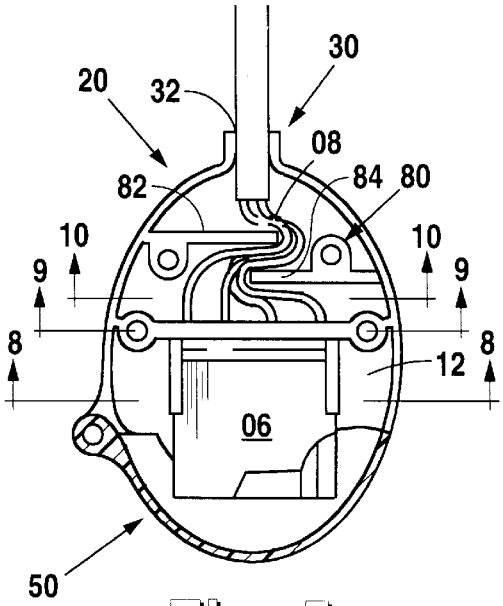
FIG. 5 is plan view of the base of the holder with the top removed therefrom showing the holder's interior space. The door is shown in section.
Figure 8:
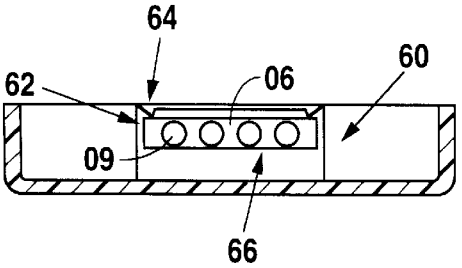
FIG. 8 is a sectional view taken along line 8—8 as illustrated in FIG. 5 showing the electrical connection component installed within the housing.
Figure 12:
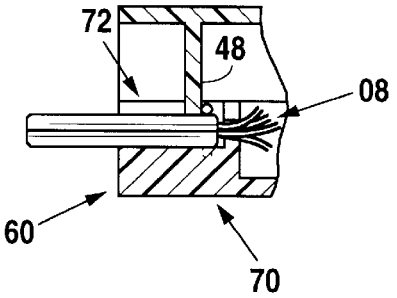
FIG. 12 is a sectional view taken from the side of an electrical connection component installed upon a rail and engaged by the stabilizer.

As illustrated in FIG. 1, the closure 50 is located at the back side of the holder 04 so that when an electrical connection component 06 is properly installed within the housing 10, the electrical contacts 09 are exposed through the closeable opening 90 and ready to receive the electrical contacts of a mating plug from the trailer's lighting system. When properly installed within the holder 02, the electrical connection component 06 is fixed relative to the housing 10 by releasable engagement with retainer 60. Referring to FIGS. 5, 8, and 12, the structure of the retainer 60 may be seen, as well as proper orientation of the electrical connection component 06 when fixed therein. FIG. 8 shows the electrical contacts 09 as seen through the opening 90. In the illustrated embodiment, a supporting ledge 66 is shown upon which the electrical connection component 06 rests.

Upwardly extending flexible fingers 62 are shown that have inward projections 64 at top ends thereof. The fingers 62 are biased inwardly so that when an electrical connection component 06 is installed therebetween, each presses snugly thereagainst. In that way, the inward projections or tabs 64 are maintained securely above the electrical connection component 06. The tabs 64 prevent the electrical connection component 06 from inadvertently becoming disengaged from the retainer 60. The fingers 62 are sufficiently flexible, however, that they may be manually pushed outwardly so that the tabs 64 are no longer above the electrical connection component 06 and it may then be released therefrom. In an alternative embodiment, the fingers 62 are elongated into rails 70 that have inward projections 72 that are similar to tabs 64, but each extends along the length of a top end of one of the rails 70. The railed configuration is illustrated in FIG. 12. A downwardly projecting stabilizer 48 is also shown. The stabilizer 48 is an appendage of the top 40 and extends downwardly therefrom to engage a top surface of the electrical connection component 06 when the housing 10 is assembled. The stabilizer 48 maintains the electrical connection component 06 in the retainer 60 and prevents its disengagement therefrom.

Figure 9:
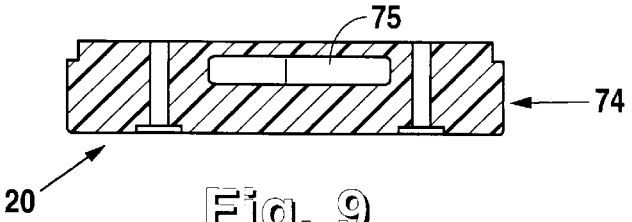
FIG. 9 is a sectional view taken along line 9—9 of FIG. 5 showing a supporting wall.

A supporting wall 74 is shown in FIG. 9, in section. An aperture 75 therethrough is shown that accommodates an electrical connection component 06 inserted therein. A lower surface of the aperture 75 provides the ledge 66, or a portion thereof, upon which the electrical connection component 06 rests. The wall 74 also serves as a brace for the housing 10, lending support thereto and providing a structural component through which tubular apertures 39 of a connection assembly 34 may extend.

A frictional wire path 80 is created within the interior space 12 of the holder 02, in front of the retainer 60. As previously explained, the purpose of the frictional wire path 80 is to provide a tortious path within which the connective wires 08 between the electrical connection component 06 and the electrical system of the carrying vehicle 04 are held. A series of baffle vanes 82 are configured within the housing 10 so that alternating vanes 82 opposingly project across the housing 10. The length of the vanes 82 is sufficient to cause distal ends 84 of opposing vanes 82 to overlap and extend beyond the other, as illustrated in FIG. 5. When one or more wires 08 are positioned within the path 80, each wire 08 engages each vane's 82 distal end 84 so that friction is established therebetween. The generated friction resists relative movement between the two components. Furthermore, as the wires 08 are pulled more taught, they press more firmly against the ends 84 and a greater frictional resistance force is created. Though the several wires 08 may be independent in the frictional wire path 80 proximate to their connection to the electrical connection component's 06 contacts 09, they are normally bundled together and commonly sheathed at the wiring orifice 30. The sheath 07 provides a more uniform exterior surface about the wiring 08 upon which the sealant 32 of the wiring orifice 30 may seat for creating a seal therebetween.

When the holder 02 is assembled with an electrical connection component 06 fixedly installed therein, it is attached to the carrying vehicle 04 by the connection assembly 34. The connection assembly 34 includes the tubular apertures 39 that extend through the housing 10 at interior supporting walls 74, as may be seen in FIGS. 5, 9, and 10. The base 20 and top 40 will be similarly configured with respect to the tubular apertures 39 so that when the clamshell configuration of the housing 10 is established, a uniform tubular passage 39 is created through the holder 02. The top portion and base portion of the tubular aperture 39 meet at abutting edges and engage one another in a manner that a sufficient seal is achieved therebetween creating a moisture and particulate barrier between the exterior of the holder 02 and its interior space 12. As may be seen in FIG. 2, recesses 38 are provided at the ends of the tubular apertures in the exterior surface 14 of the housing 10. The recess 38 accommodates a head 37 of self-tapping screws 36 when the screws 36 are inserted into the tubular apertures 39 and secured therein. The recess 38 allows a top surface of the screw's 36 head 37 to be flush with the exterior surface 14 of the holder 012 thereby maintaining the surface 14 uniform.

In practice, the several pieces of the holder 02 will be initially manufactured. In the preferred embodiment, the base 20, top 40, and closure 50 are molded from plastic. The retainer assembly 60 and the support walls 74, including lower portions of the tubular apertures 39 are integrally constructed with the base 20. An electrical connection component 06 is manually installed by the operator into the retainer 60 by flexing the fingers 62 or rails 70 outwardly by pressing the electrical connection component 06 against ramped surfaces thereon and into the retainer 60 from above. When the electrical connection component 06 is sufficiently inserted and resting upon the supporting ledge 66, the fingers 62 are allowed to bias back against sides of the component 06 so that the inward projections or tabs 64 clip above the top of the electrical connection component 06 as shown in FIG. 8. A front portion away from the electrical contacts 09 of the electrical connection component 06 may be fixed relative to the base 20 within the aperture 75. The electrical wiring 08 connected to a front side of the electrical connection component 06 is then laid within the frictional wire path 80 as shown in FIG. 5. The individual wires 08 are then bundled in a common sheath 07 and laid within the lower portion of the wiring orifice 30 formed in the base 20. The sheath 07 may be already present as part of the electrical connection component 06 when installed, or it may be created by the operator by wrapping the several wires in electrical tape.

The housing 10 is then assembled by pressing the base 20 and top 40 into abutting engagement so that their respective lips 24,44 mate forming a moisture and particulate resistant barrier therebetween. In the process, the tubular apertures 39 of the connection assembly 34 are established, as is the seal about the wiring sheath 07. The closure or door 50 is then installed by aligning the bores of the closure 50 and housing 10 so that the hinge pin 58 may be inserted and secured therein. The closure 50 is now pivotally connected to the housing 10 and may be opened and closed by an operator. With the holder 02 completely assembled, it is located upon the bumper 05 of the carrying vehicle 04. The self-tapping screws 36 are inserted into the tubular apertures 39 and tapped into the bumper 05. Each screw 36 is advanced until its head 37 is snugly pressed into the recess 38 thereby securing the holder 02 to the vehicle 04. The electrical wiring 08 may be already connected into the electrical lighting system of the carrying vehicle 04, or the wiring 08 may now be spliced thereto.

In operation and after installation of the holder 02 onto the carrying vehicle 04, the closure 50 will be opened by grasping the frictional indentation 56 when it is desired to connect a trailer's lighting system to that of the towing vehicle 04. With the closure 50 open, the electrical contacts 09 of the electrical connection component 06 are exposed and made available to receive plugging contacts from the trailer's lighting system. During use, the closure 50 remains in an open position. After use, the plug is disengaged from the electrical connection component 06 and the closure 50 is allowed to swing closed. As an option, a biasing means, preferably in the form of a spring, may be included to urge the closure 50 to the closed position. This feature will further assure that the closure 50 remains closed when a plug is not installed therein.

In the event that access is required to the interior space 12 of the holder 02 after installation upon the carrying vehicle 04 to repair or replace the electrical connection component 06, the above referenced steps are reversed.

It will be appreciated by those of skill in this particular art that the foregoing detailed description is to be clearly understood as being given by way of illustration and example only of the subject invention. The spirit and scope of the present invention is limited solely by the appended claims.

What is claimed is:

1. A holder for a vehicle electrical connection component, said holder comprising:

a housing comprising a base and a top;

said base having a generally upward extending base flange about a perimeter of said base, said base flange terminating in a base lip at an upper surface thereof and said top having a generally downward extending top flange about a perimeter of said top, said top flange terminating in a top lip at a lower surface thereof, said top lip being adapted for abutting engagement with said base lip;

a retainer for an electrical connection component fixed within said housing;

a closable opening through said housing for permitting access to an interior space of said housing; and a frictional wire path for resisting relative movement between wires lodged therein and said housing.

2. The holder for a vehicle electrical connection component as recited in claim 1, wherein said abutting engagement between said base and said top mates said base to said top thereby establishing a moisture resistant seal therebetween.

3. The holder for a vehicle electrical connection component as recited in claim 1, wherein said frictional wire path further comprises a plurality of baffle vanes, each vane having a distal end and said distal ends of adjacent baffle vanes opposingly projecting toward and beyond the other so that a wire installed within said path frictionally engages said distal end of each baffle vane.

4. The holder for a vehicle electrical connection component as recited in claim 1, wherein said housing further comprises a wiring orifice located generally opposite to said closeable opening.

5. The holder for a vehicle electrical connection component as recited in claim 4, wherein said wiring orifice includes a sealant at an interior surface of said orifice for establishing sealing engagement with a wire extending through said orifice.

6. The holder for a vehicle electrical connection component as recited in claim 1, wherein said retainer for an electrical connection component is integrally formed with said base.

7. The holder for a vehicle electrical connection component as recited in claim 6, wherein said retainer for an electrical connection component comprises an upwardly extending flexible finger having an inward projection proximate to an upper end of said finger for releasably engaging an electrical connection component within said retainer.

8. The holder for a vehicle electrical connection component as recited in claim 6, wherein said retainer for an electrical connection component comprises an upwardly extending rail having an inward projection proximate to an upper surface of said rail for releasably engaging an electrical connection component within said retainer; said rail having a length and capable of supporting an electrical connection component upon said upper surface of said rail.

9. The holder for a vehicle electrical connection component as recited in claim 8, wherein said top further comprises a downwardly projecting stabilizer for engaging an electrical connection component supported upon said rails.

10. The holder for a vehicle electrical connection component as recited in claim 1, wherein said holder further comprises a closure for said closable opening.

11. The holder for a vehicle electrical connection component as recited in claim 10, wherein said closure for said closable opening further comprises a closure lip that securely engages an opening lip of said closable opening thereby establishing a moisture resistant seal therebetween when said closure is in a closed position.

12. The holder for a vehicle electrical connection component as recited in claim 11, wherein said closure is pivotally connected to said housing by a hinge formed at an exterior surface of said housing.

13. The holder for a vehicle electrical connection component as recited in claim 12, wherein said closure further comprises a frictional indentation located upon an exterior surface of said closure and substantially opposite to said hinge for facilitating an operator's grasping engagement of said closure.

14. The holder for a vehicle electrical connection component as recited in claim 13, wherein said exterior surface of said closure fits flushly to said exterior surface of said housing thereby presenting a uniform exterior surface of said holder at an intersection between said closure and said housing.

15. The holder for a vehicle electrical connection component as recited in claim 1, wherein said holder further comprises a connection assembly for coupling said holder to a carrying vehicle.

16. The holder for a vehicle electrical connection component as recited in claim 15, wherein said connection assembly further comprises a tubular aperture extending through said housing from an upper housing surface to a lower housing surface.

17. The holder for a vehicle electrical connection component as recited in claim 16, wherein said tubular aperture terminates in a recess at said exterior surface of said housing.

18. The holder for a vehicle electrical connection component as recited in claim 1, wherein said holder is constructed exclusively from plastic.

19. The holder for a vehicle electrical connection component as recited in claim 1, wherein said holder is mounted to a bumper of a carrying vehicle.

20. The holder for a vehicle electrical connection component as recited in claim 1, wherein said holder is mounted to a bumper of a carrying vehicle by a self tapping headed screw positioned within a tubular aperture extending through said housing with a head of said screw located within a recess at an exterior surface of said housing so that said screw does not extend beyond said housing's exterior surface.

* * * * *